US007271373B2

(12) United States Patent
Oh et al.

(10) Patent No.: US 7,271,373 B2
(45) Date of Patent: Sep. 18, 2007

(54) MICROWAVE OVEN

(75) Inventors: Keun Seuk Oh, Suwon-si (KR); Sung Wook Cho, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/108,649

(22) Filed: Apr. 19, 2005

(65) Prior Publication Data

US 2005/0247705 A1 Nov. 10, 2005

(30) Foreign Application Priority Data

Apr. 22, 2004 (KR) ..... 10-2004-0027850

(51) Int. Cl.
*H05B 6/72* (2006.01)

(52) U.S. Cl. ..... 219/681; 219/746

(58) Field of Classification Search ..... 219/681, 219/679, 745–751, 695–696, 756; 333/227, 333/231; 221/150 A, 150 R, 150 HC; 99/355, 99/357, 427, 473, 475; 126/21 A; 426/241, 426/466

See application file for complete search history.

(56) References Cited

U.S. PATENT DOCUMENTS 4,283,614 A * 8/1981 Tanaka et al. ..... 219/681

5,958,274 A * 9/1999 Dobie et al. ..... 219/681

FOREIGN PATENT DOCUMENTS

| | | | |
|---|---|---|---|
| KR | 90-20714 | U | 12/1990 |
| KR | 92-12717 | U | 7/1992 |
| KR | 97-24718 | U | 6/1997 |
| KR | 97-24719 | U | 6/1997 |
| KR | 0115488 | Y1 | 12/1997 |
| KR | 2001-57085 | A | 7/2001 |
| KR | 2001-64853 | A | 7/2001 |
| KR | 2001-64854 | A | 7/2001 |
| KR | 10-377733 | B1 | 3/2003 |
| KR | 10-0402585 | B1 | 10/2003 |

* cited by examiner

*Primary Examiner*—Quang Van
(74) *Attorney, Agent, or Firm*—Sughrue Mion pllc.

(57) ABSTRACT

A microwave oven having a cooking chamber, at least one heat outlet provided in a sidewall of the cooking chamber, at least one heat inlet provided in the center of the sidewall of the cooking chamber, and a convection assembly. The convection assembly is disposed on an external side of the sidewall of the cooking chamber, and includes a fan, a heating element, and at least one guide bracket which guides heat from the heating element through the at least one heat outlet and into the cooking chamber. According to this configuration, a microwave oven heats food more evenly and efficiently.

5 Claims, 5 Drawing Sheets

MICROWAVE OVEN

CROSS-REFERENCE TO RELATED APPLICATIONS

This application claims the benefit of Korean Patent Application No. 2004-27850, filed Apr. 22, 2004 in the Korean Intellectual Property Office, the disclosure of which is incorporated herein by reference.

BACKGROUND OF THE INVENTION

1. Field of the Invention

The present invention relates to a microwave oven, and more particularly an improved microwave oven employing a convection assembly to forcibly convect heat into a cooking chamber.

2. Description of the Related Art

In general, a microwave oven heats food by irradiating high frequency microwaves generated by a magnetron to food and vibrating molecules of the food without directly heating the food. The microwave oven may be classified as a turn-table type or a stirrer fan type.

In addition, there are mono-functional microwave ovens which heat food by irradiating it with high frequency microwaves, and multifunctional microwave ovens which heat the food by both irradiating it with high frequency microwaves and by forcibly convecting heat (generated by a convection assembly provided in a cooking chamber) into the cooking chamber.

Most convection assemblies employed in conventional multifunctional microwave ovens emit heat, generated by a heater provided inside a casing, into a cooking chamber through a heat outlet by a rotating fan. Such multifunctional microwave ovens are disclosed in the Korean Utility Model Application Nos. 20-1996-036052 and 20-1999-0027806.

However, the aforesaid conventional microwave ovens unevenly heat food because the heat convected by the convection assembly is directly emitted to the inside of the cooking chamber.

If a rack is provided in the microwave oven instead of a turn-table, the food is more unevenly heated.

SUMMARY OF THE INVENTION

Accordingly, it is an aspect of the present invention to provide an improved microwave oven which can heat food evenly by changing the direction of heat that is emitted into a cooking chamber by a convection assembly.

The foregoing and/or other aspects of the present invention are also achieved by providing a microwave oven comprising a cooking chamber; at least one heat inlet provided in a center portion of a side wall of the cooking chamber; at least one heat outlet provided in the sidewall of the cooking chamber; and a convection assembly disposed on the external side of the sidewall of the cooking chamber. The convection assembly comprises a fan, a heating element, and at least one guide bracket, which guides heat from the convection assembly through the at least one heat outlet into the cooking chamber.

According to one aspect of the present invention, at least one guide bracket is adjacent to each sidewall of the casing, and at least one heat outlet is provided in each corner of the sidewall of the cooking chamber.

According to another aspect of the present invention, the microwave oven further comprises a rack detachably disposed in a center portion of the cooking chamber.

BRIEF DESCRIPTION OF THE DRAWINGS

The above and/or other aspects and advantages of the present invention will become apparent and more readily appreciated from the following description of the embodiments, taken in conjunction with the accompany drawings in which.

DETAILED DESCRIPTION OF THE INVENTION

Figure 1:
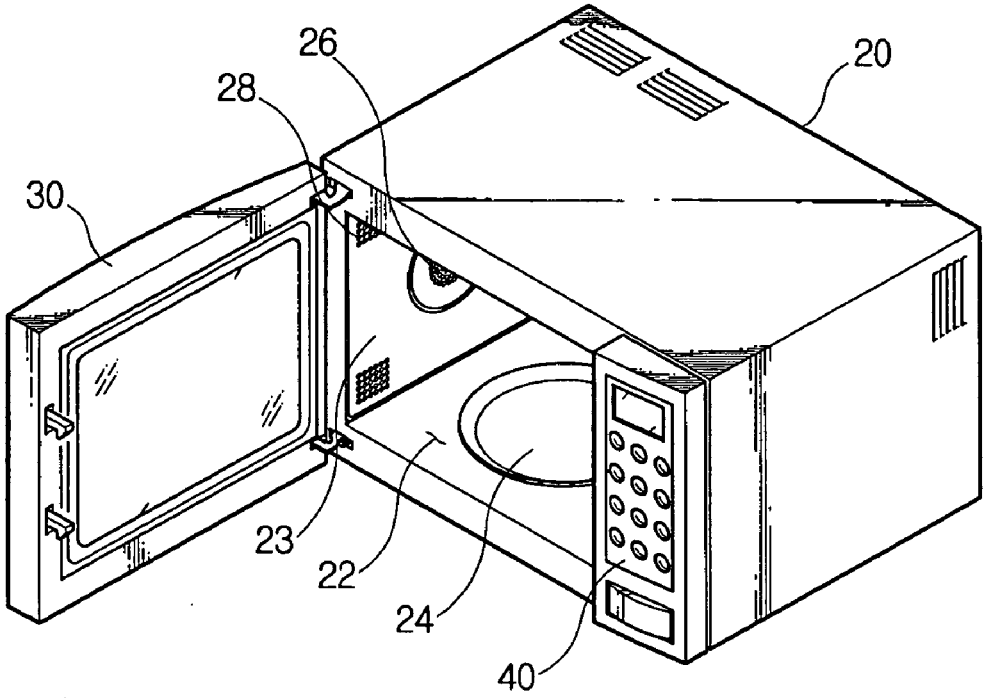
FIG. 1 is a perspective view of a microwave oven according to an exemplary embodiment of the present invention.

Reference will now be made in detail to exemplary embodiments of the present invention, examples of which are illustrated in the accompanying drawings, wherein like reference numerals refer to like elements throughout.

As shown in FIGS. 1-4, a microwave oven according to an exemplary embodiment of the present invention comprises a main body 20 forming a cooking chamber 22; a door 30 rotatably provided in a front side of the main body 20, for selectively opening and closing the cooking chamber 22; a control panel 40 provided in a front side of the main body 20; and a convection assembly 50 disposed adjacent to a side of the cooking chamber 22 and within the main body 20.

The main body 20 forms the external appearance of the microwave oven, and the food is placed within the cooking chamber 22 to be heated. The control panel 40 is provided to readily control the microwave oven, and an equipment compartment (not shown) is provided in a rear part thereof to equip a plurality of components such as a magnetron (not shown), for generating high frequency microwave to heat the food.

Figure 2:
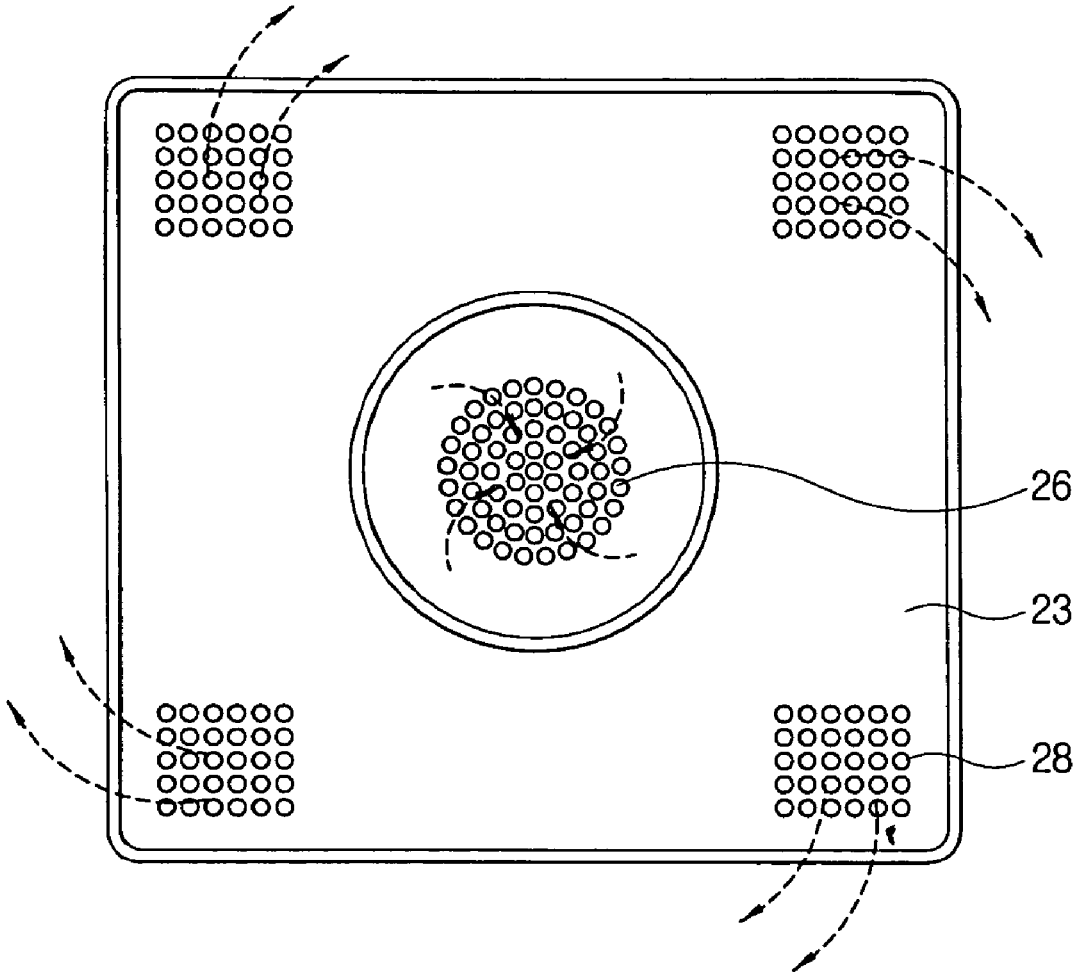
FIG. 2 is a front view of a sidewall of a cooking chamber of a microwave oven according to an exemplary embodiment of the present invention.

As shown in FIG. 2, a plurality of heat inlets 26 are provided in a center portion of a sidewall 23 of the cooking chamber 22 to remove heat from inside the cooking chamber 22, and a plurality of heat outlets 28 are provided in the sidewall 23 to emit the heat into the inside of the cooking chamber 22.

The structure of the heat inlets 26 and heat outlets 28 can vary as long as the heat is smoothly removed from and emitted into the cooking chamber 22. This embodiment of the present invention is particularly efficient if the heat outlets 28 are provided in the four corners of the sidewall 23, as shown, for example, in FIG. 2.

Figure 5:
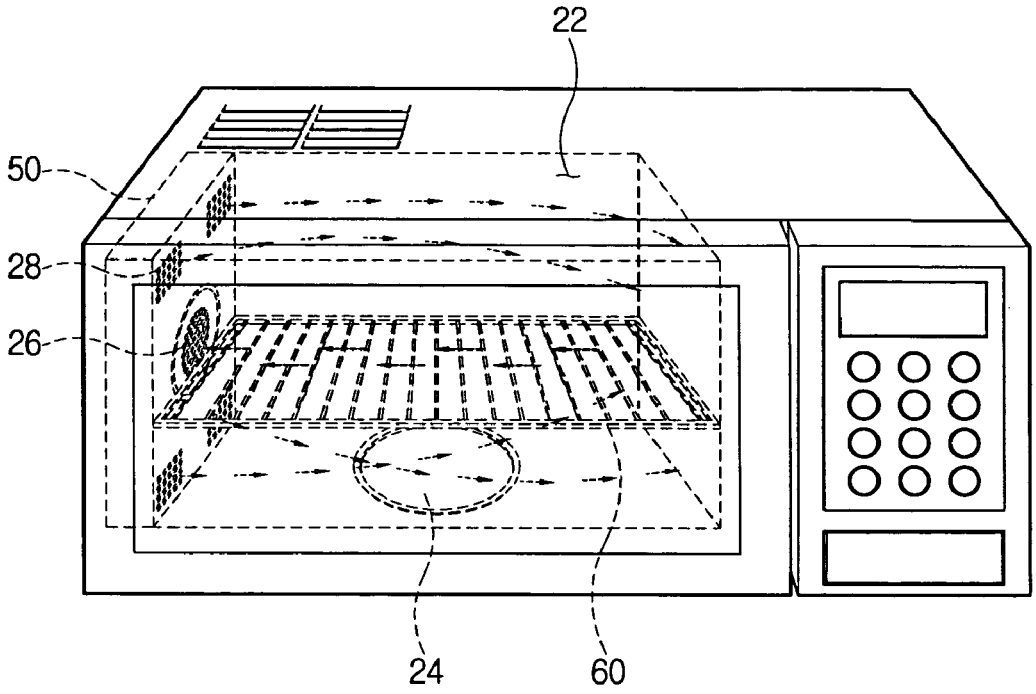
FIG. 5 is a schematic view illustrating a heat flow in the cooking chamber of a microwave oven according to an exemplary embodiment of the present invention.

As shown in FIG. 5, a rotational tray 24 can be provided on a bottom surface of the cooking chamber 22, and, a rack 60 may be provided in a center portion of the cooking chamber 22.

Figure 3:
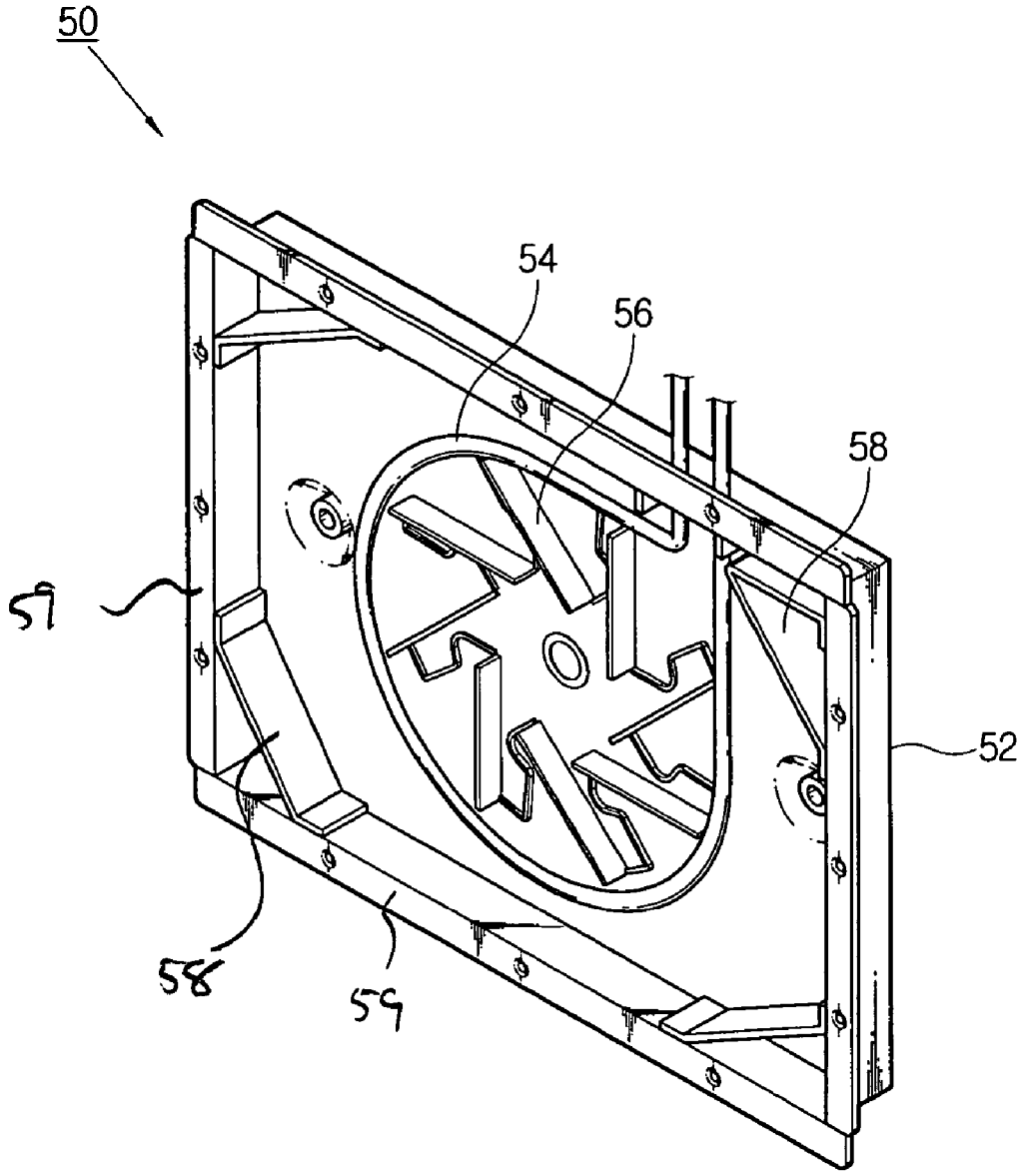
FIG. 3 is a perspective view of a convection assembly provided in a microwave oven according to an exemplary embodiment of the present invention.
Figure 4:
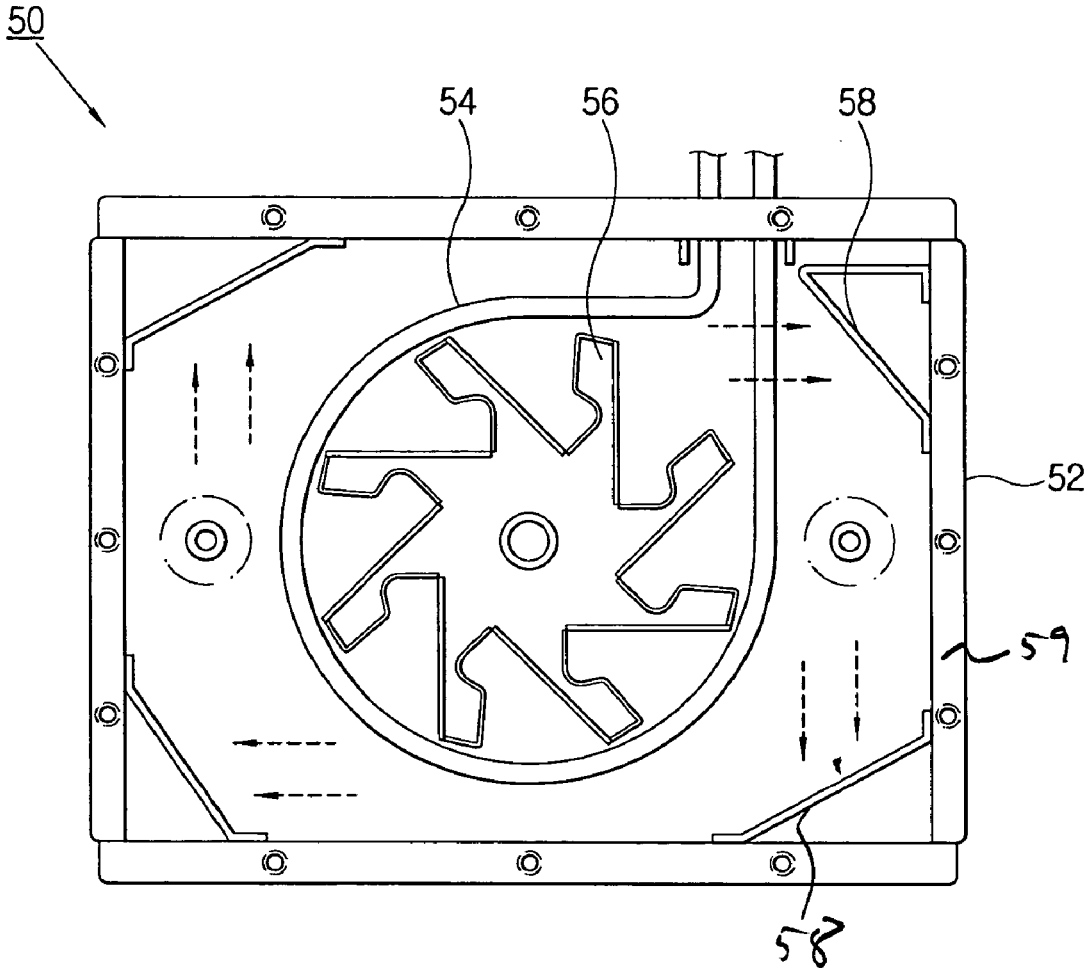
FIG. 4 is a front view of a convection assembly provided in a microwave oven according to an exemplary embodiment of the present invention.

The convection assembly 50, as shown in FIGS. 3 and 4, heats the food by forcibly convecting heat into the cooking chamber 22. The assembly 50 comprises a casing 52 disposed adjacent to a sidewall of the cooking chamber 22 and within the main body 20. A heater 54, a fan 56, and a guide bracket 58 are provided inside the casing 52 to guide heat through the plurality of heat outlets 28 and to the four sidewalls (up/down/front/rear) of the cooking chamber 22.

One side of the casing 52 is open, and the open side is attached to the sidewall 23 of the cooking chamber 22 and thereby communicates with the heat inlets 26 and the heat outlets 28 in the sidewall 23. The casing may be attached to the sidewall 23 by means of flanges 59, as shown in FIG. 3. The heater 54 encircles the fan 56. The fan 56 is placed in a center portion of the casing 52 and is rotated by a driving device (not shown).

Guide brackets 58 guide the heat blown by the fan 56 to the heat outlets 28, and can be disposed in any place where they can convect the heat into the cooking chamber 22. The guide brackets 58 can be disposed in each corner of the casing 52, so as to be in positions corresponding to the heat outlets 28, for efficient convection.

FIG. 5 schematically illustrates a flow of heat inside the cooking chamber 22 of a microwave oven according to an exemplary embodiment of the present invention.

As shown therein, when the convection assembly 50 is running, the heat is emitted into the cooking chamber 22 through the heat outlets 28, and the emitted heat circulates along the inner sidewalls of the cooking chamber 22.

The heat circulating along the inner sidewalls of the cooking chamber 22 returns to the casing 52 through heat inlets 26, and is repeatedly emitted through the heat outlets 28.

Therefore, food put on the rack 60 is evenly heated as heat is repeatedly emitted from heat outlets 28 into the chamber 22, returned to the casing 52 through heat inlets 26 and emitted back through the heat outlets 28.

As described herein, both a rotational tray 24 and a rack 60 are used. However, a microwave according to the present invention may have only one of a rotational tray or a rack.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven, comprising:

a cooking chamber;

at least one heat outlet provided in a sidewall of the cooking chamber;

at least one heat inlet provided in the center of the sidewall of the cooking chamber;

a convection assembly, disposed on an external side of the sidewall of the cooking chamber, comprising:

a fan, a heating element, and at least two guide brackets each comprising a bent plate member disposed adjacent to and spanning at an angle a corresponding corner of the sidewall and which guide heat from the convection assembly though the at least one heat outlet and into the cooking chamber.

2. The microwave oven according to claim 1, wherein at least one guide bracket is disposed adjacent to each corner of the sidewall, and the at least one heat outlet comprises at least one heat outlet provided in each corner of the sidewall.

3. The microwave oven according to claim 2, further comprising a rack detachably disposed in a center portion of the cooking chamber.

4. The microwave oven according to claim 1, further comprising a rack detachably disposed in a center portion of the cooking chamber.

5. The microwave oven according to claim 1, wherein the sidewall is a wall other than a rear wall of the cooking chamber.

* * * * *